US009700935B2

(12) United States Patent
Sasaki et al.

(10) Patent No.: US 9,700,935 B2
(45) Date of Patent: Jul. 11, 2017

(54) MANUFACTURING METHOD OF CASTING, MANUFACTURING DEVICE THEREOF, AND CASTING

(71) Applicants: Yu Sasaki, Toyota (JP); Yuichi Furukawa, Toyota (JP); Norihiro Amano, Toyota (JP); Jun Yaokawa, Nagakute (JP); Yasushi Iwata, Nagakute (JP); Yoshio Sugiyama, Nagakute (JP)

(72) Inventors: Yu Sasaki, Toyota (JP); Yuichi Furukawa, Toyota (JP); Norihiro Amano, Toyota (JP); Jun Yaokawa, Nagakute (JP); Yasushi Iwata, Nagakute (JP); Yoshio Sugiyama, Nagakute (JP)

(73) Assignees: TOYOTA JIDOSHA KABUSHIKI KAISHA, Toyota-shi (JP); KABUSHIKI KAISHA TOYOTA CHUO KENKYUSHO, Nagakute-shi (JP)

( * ) Notice: Subject to any disclaimer, the term of this patent is extended or adjusted under 35 U.S.C. 154(b) by 316 days.

(21) Appl. No.: 14/385,600

(22) PCT Filed: Mar. 13, 2013

(86) PCT No.: PCT/JP2013/001642

§ 371 (c)(1),
(2) Date: Sep. 16, 2014

(87) PCT Pub. No.: WO2013/136785

PCT Pub. Date: Sep. 19, 2013

(65) Prior Publication Data

US 2015/0071817 A1 Mar. 12, 2015

(30) Foreign Application Priority Data

Mar. 16, 2012 (JP) ..... 2012-061030

(51) Int. Cl.
*B22D 11/041* (2006.01)
*B22D 11/14* (2006.01)
(Continued)

(52) U.S. Cl.
CPC ..... *B22D 11/041* (2013.01); *B22D 11/006* (2013.01); *B22D 11/124* (2013.01); *B22D 11/145* (2013.01)

(58) Field of Classification Search
CPC ... B22D 11/145; B22D 11/006; B22D 11/124; B22D 11/041
See application file for complete search history.

(56) References Cited

U.S. PATENT DOCUMENTS

| | | | | |
|---|---|---|---|---|
| 6,217,803 | B1 | 4/2001 | Uozumi | |
| 2009/0050290 | A1* | 2/2009 | Anderson | B22D 11/049 164/483 |
| 2013/0171021 | A1 | 7/2013 | Yaokawa et al. | |

FOREIGN PATENT DOCUMENTS

| | | | |
|---|---|---|---|
| CN | 103124604 | A | 5/2013 |
| JP | 58-103941 | A | 6/1983 |

(Continued)

OTHER PUBLICATIONS

International Search Report issued Jul. 11, 2013, in PCT/JP13/001642, filed Mar. 13, 2013.

(Continued)

*Primary Examiner* — Kevin P Kerns
*Assistant Examiner* — Steven Ha
(74) *Attorney, Agent, or Firm* — Oblon, McClelland, Maier & Neustadt, L.L.P.

(57) ABSTRACT

There are provided a manufacturing method of a casting capable of easily manufacturing a casting having a complex form and of increasing the degree of freedom of form of the casting to be manufactured, a manufacturing device thereof and a casting. At the time of forming a casting by drawing out molten metal from a bath surface of a molten metal bath and solidifying the molten metal which has been drawn out, an outer contour unit configured from a plurality of outer contour defining members for defining the outer contour of a casting is arranged in a region between the bath surface of (Continued)

the molten meth bath and a solid region where the molten metal is solidified and the molten metal which has been drawn out from the bath surface is drawn out through a region determined by the outer contour unit, and the form of the casting is changed by moving at least one of the plurality of outer contour defining members according to the drawing out of the molten metal.

16 Claims, 9 Drawing Sheets

(51) Int. Cl.
*B22D 11/00* (2006.01)
*B22D 11/124* (2006.01)

(56) References Cited

FOREIGN PATENT DOCUMENTS

| | | |
|---|---|---|
| JP | 59-130649 A | 7/1984 |
| JP | 63-199050 | 8/1988 |
| JP | 02-205232 A | 8/1990 |
| JP | 02-251341 | 10/1990 |
| JP | 09-248657 | 9/1997 |
| WO | 2012/035752 | 3/2012 |

OTHER PUBLICATIONS

Written Opinion of the International Searching Authority issued Jul. 11, 2013, in PCT/JP13/001642, filed Mar. 13, 2013.

* cited by examiner

Fig. 1
(a)
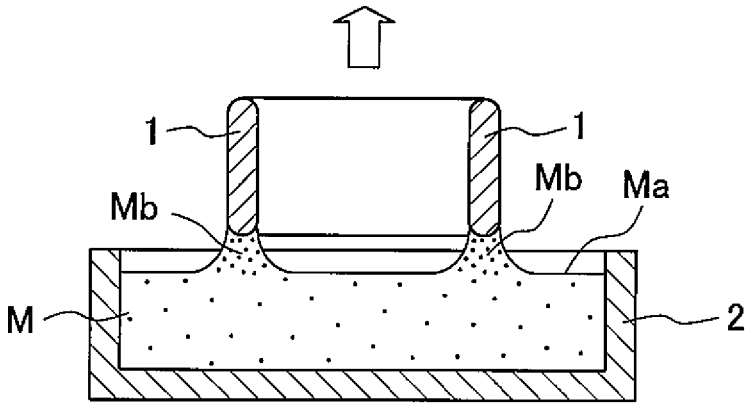
(b)
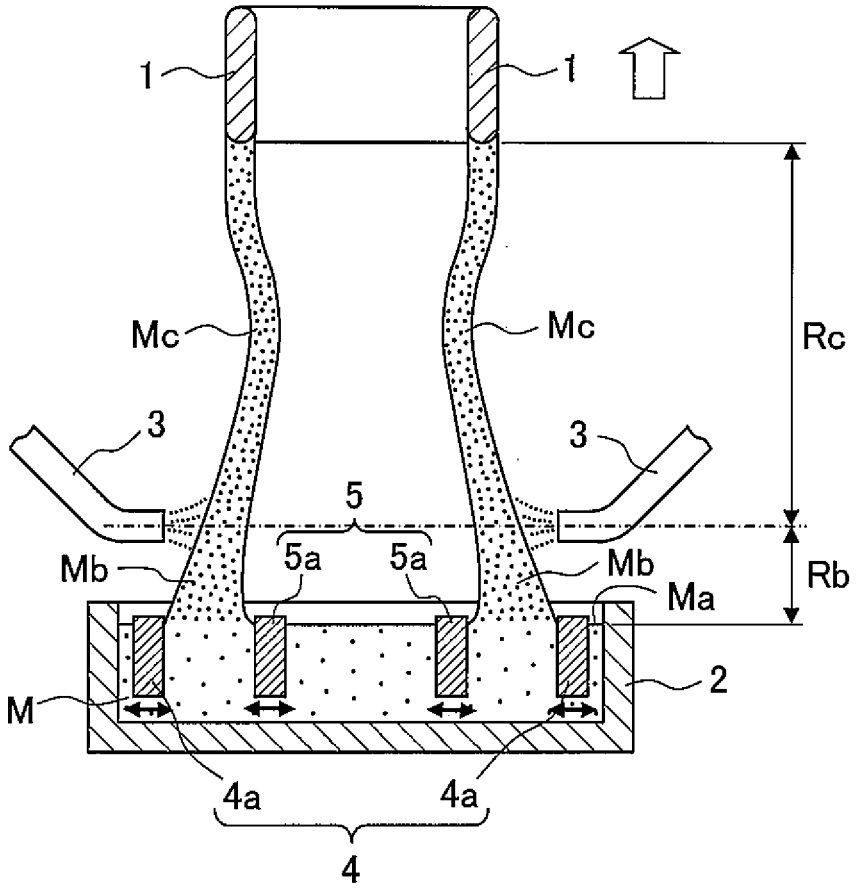

Fig. 5
(a)
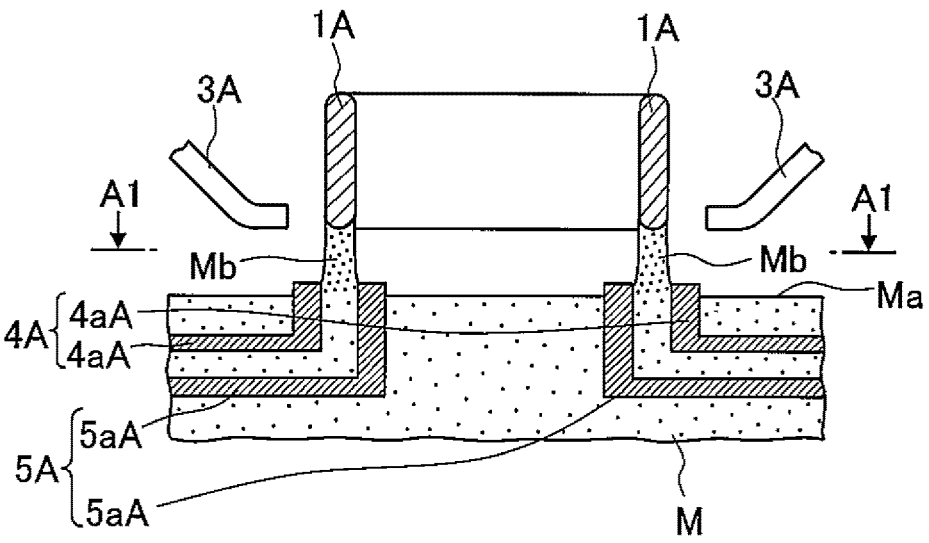
(b)
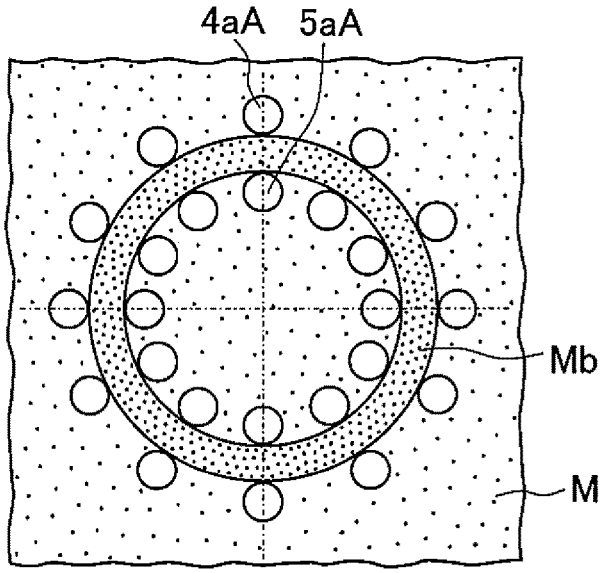

Fig. 6
(a)
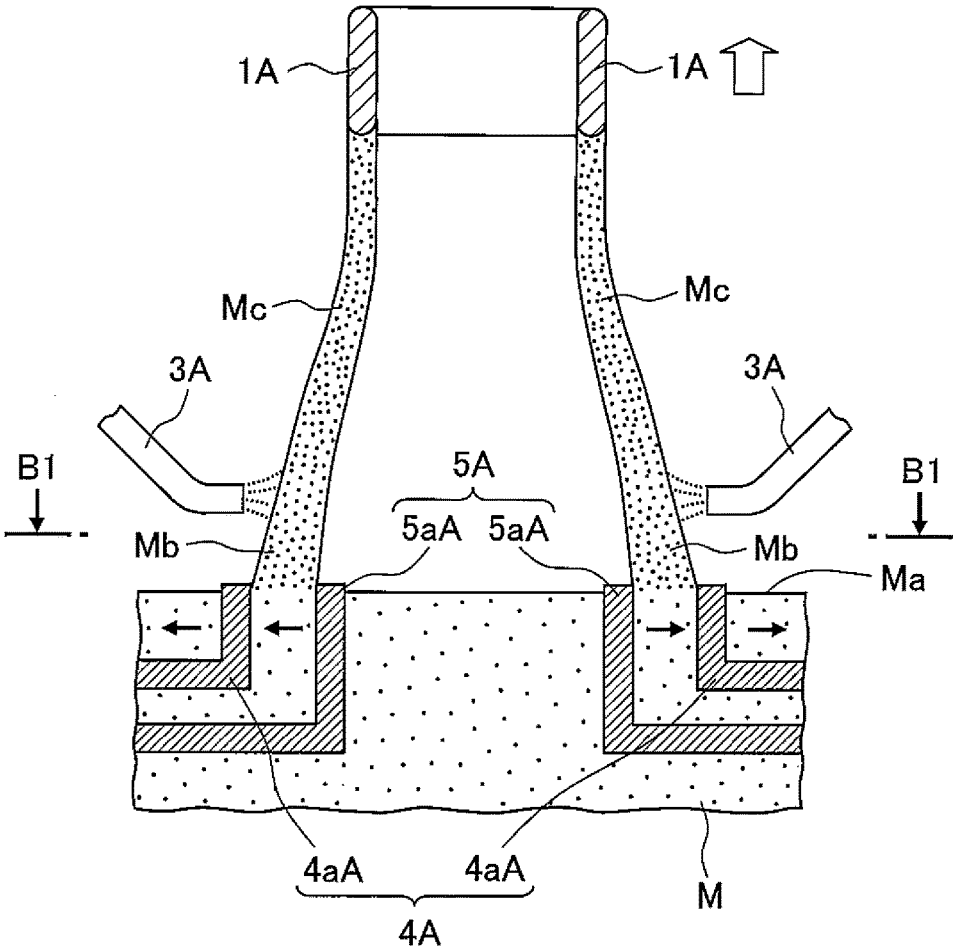
(b)
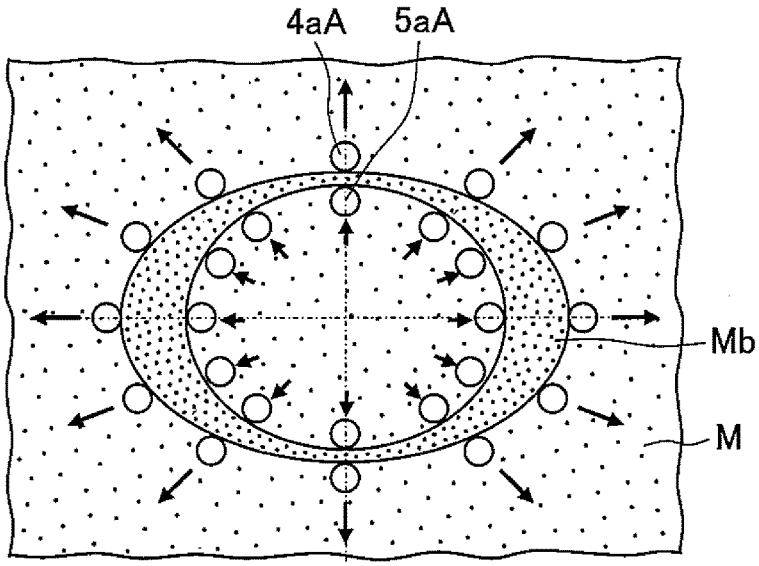

Fig. 7
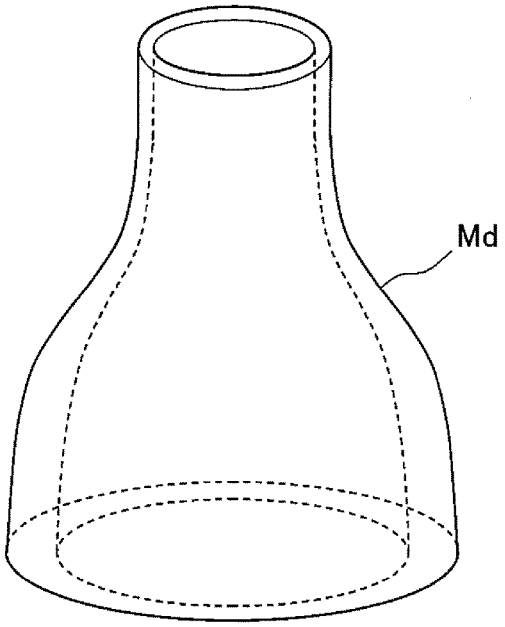
[Fig. 8]
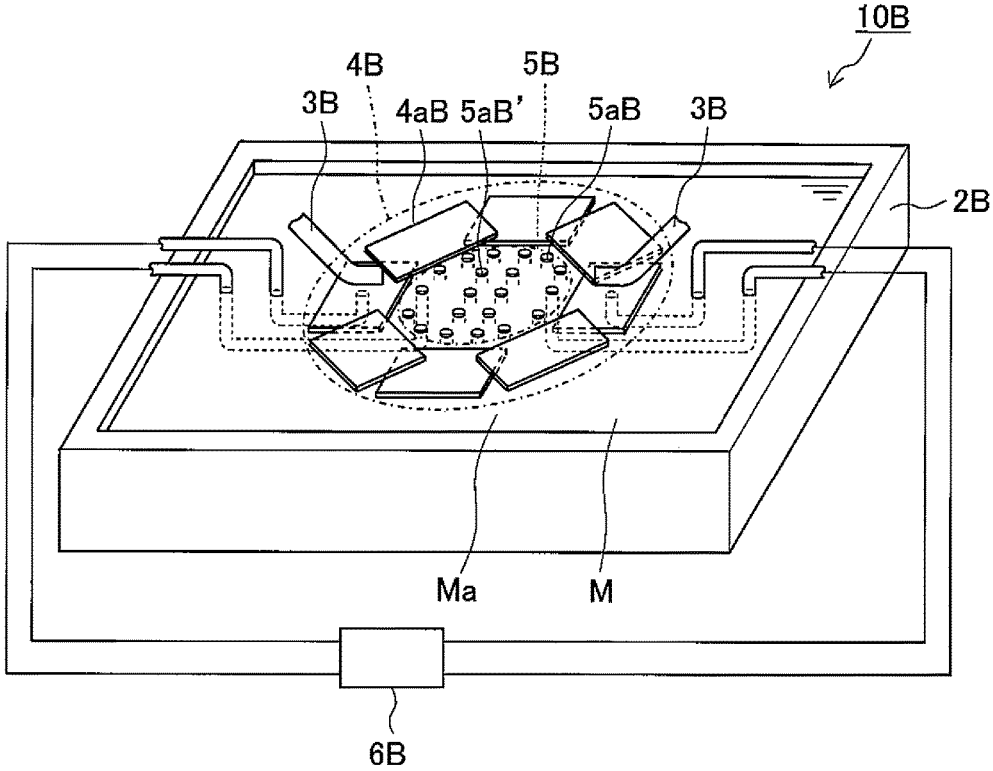

Fig. 9
(a)
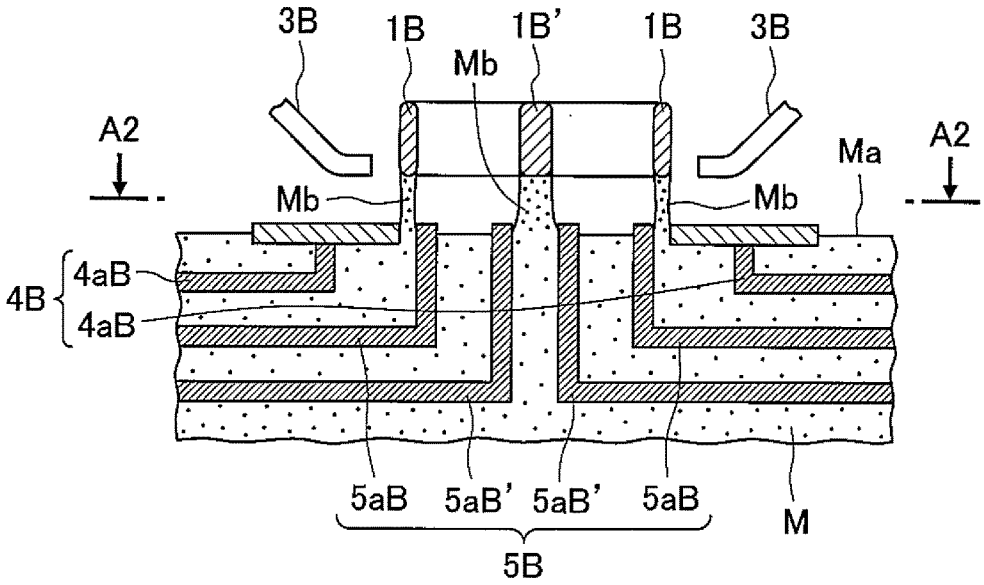
(b)
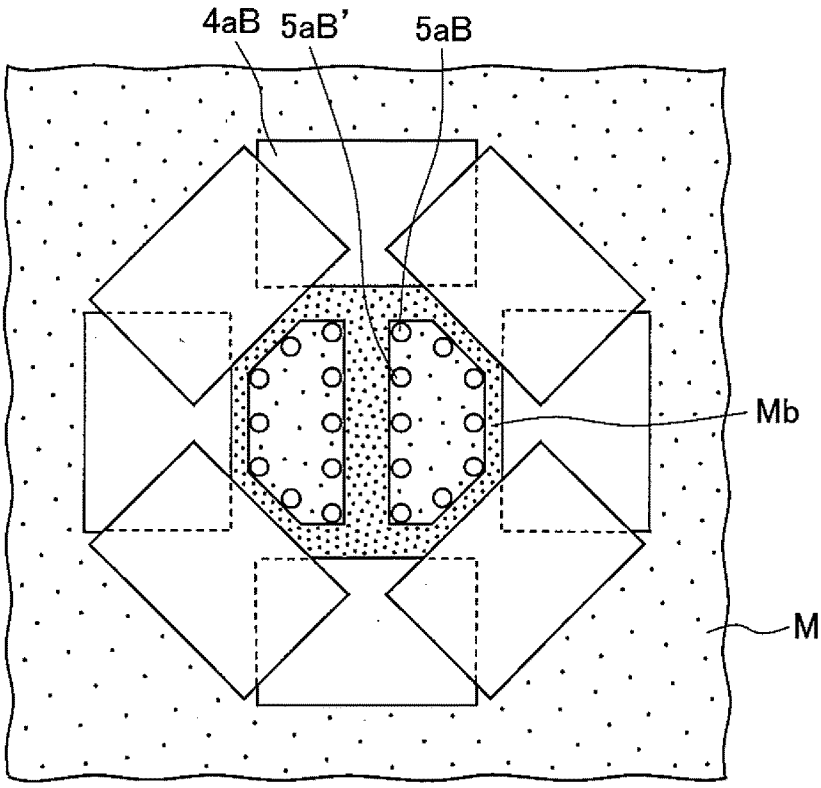

[Fig. 10]

MANUFACTURING METHOD OF CASTING, MANUFACTURING DEVICE THEREOF, AND CASTING

BACKGROUND OF THE INVENTION

Field of the Invention

The present invention relates to a manufacturing method of a casting, a manufacturing device thereof, and a casting, and particularly, to a manufacturing method of a casting that uses a free casting method, a manufacturing device thereof, and a casting that is manufactured using the free casting method.

Description of the Related Art

Conventionally, a metallic product having a complex form is manufactured by filling melted metal (molten metal) into a mold having a cavity having a predetermined form and solidifying the molten metal in the mold.

Incidentally, with a casting method that uses a mold, it is known that a casting defect such as solidification cracking, shrinkage cavity or porosity, for example, may occur because of restriction and solidification due to cooling from the inner wall surface of the cavity of the mold.

Regarding such a problem, in recent years, techniques regarding casting methods called an upward continuous casting method, a free casting method and the like that do not use a mold have been disclosed in the Related Art cited herein. These casting methods are methods of drawing out molten metal from the bath surface of a molten metal bath storing melted metal (molten metal) along a predetermined path, forming the molten metal drawn out, and solidifying. That is, when molten metal is drawn out from the bath surface of the molten metal bath, the form of the molten metal is temporarily retained by an oxide film formed on its surface or surface tension, and the methods are for forming a casting having a predetermined form by solidifying the molten metal temporarily retained its form using predetermined cooling means after the molten metal drawn out from the molten metal surface, by gradually moving the solidified metal from the bath surface with drawing out new molten metal from the bath surface, and by continuously solidifying the drawn out molten metal.

According to these casting methods, since molten metal drawn out from a molten metal bath can be continuously cooled and solidified, the problem of casting defects such as shrinkage cavities occurring within a mold may be solved, and a high quality casting can be manufactured even in the case of using alloys in which solidification cracking easily occurs, such as 6000 series wrought aluminum alloys, for example.

RELATED ART

JP Patent Publication (Kokai) No. 63-199050 A (1988)
JP Patent Publication (Kokai) No. 2-251341 A (1990)
JP Patent Publication (Kokai) No. 9-248657 A (1997)

SUMMARY OF THE INVENTION

However, with some upward continuous casting methods, there is a problem that the outer contour of a casting is defined by guide rollers, and castings that can be manufactured are limited to castings having simple forms, such as a tapered round bar.

Also, with some free casting methods, there is a problem that an outlet of molten metal is restricted by a form or a partition member provided above the bath surface of a molten metal bath, and the degree of freedom of the form of a casting to be manufactured is low.

The present invention is made in view of the above problems, and has its object to provide a manufacturing method of a casting and a manufacturing device thereof which are capable of easily manufacturing a casting having a complex form and of increasing the degree of freedom of form of the casting to be manufactured, and a casting manufactured using the manufacturing method and the manufacturing device.

To achieve the object described above, a manufacturing method of a casting of the present invention is a manufacturing method of a casting including drawing out molten metal from a bath surface of a molten metal bath and solidifying the drawn molten metal, the manufacturing method including arranging an outer contour unit configured from a plurality of outer contour defining members for defining an outer contour of the casting in a region between the bath surface of the molten metal bath and a solid region where the molten metal is solidified and drawing out the molten metal drawn out from the bath surface through a region determined by the outer contour unit, and changing the outer contour of the casting by moving at least one of the plurality of outer contour defining members according to the drawing out of the molten metal.

Here, examples of the molten metal adopted by the manufacturing method described above include metal such as iron, aluminum, magnesium, titanium and the like, and their alloys thereof. Also, "molten" includes a complete liquid phase state and a solid-liquid state where a liquid phase and a solid phase are mixed.

According to the manufacturing method described above, the molten metal before solidification is so soft that the outer contour of molten metal drawn out from the bath surface of the molten metal bath can be freely changed by simple methods including arranging an outer contour unit configured from a plurality of outer contour defining members for defining the outer contour of a casting in a region between the bath surface of the molten metal bath and a solid region where the molten metal is solidified, and moving at least one of the plurality of outer contour defining members coincident with the drawing out of the molten metal at the time of drawing out the molten metal drawn out from the bath surface through a region determined by the outer contour unit. Accordingly, since the outer contour of the molten metal in a soft state can be desirably changed while drawing out the molten metal from the bath surface of the molten metal bath, a casting having a complex form can be easily manufactured and the degree of freedom of form of a casting to be manufactured can be increased.

Also, according to the manufacturing method described above, an inner contour unit configured from a plurality of inner contour defining members for defining an inner contour of the casting is preferably arranged at an inner side of the outer contour unit and in the region between the bath surface of the molten metal bath and the solid region where the molten metal is solidified and the molten metal drawn out from the bath surface is preferably drawn out through a region determined by the outer contour unit and the inner contour unit, and the inner contour of the casting is preferably changed by moving at least one of the plurality of inner contour defining members according to the drawing out of the molten metal.

According to the manufacturing method described above, the molten metal before solidification is so soft that the outer contour and the inner contour of molten metal drawn out from the bath surface of the molten metal bath can be changed by simple methods including arranging, in a region between the bath surface of the molten metal bath and a solid region where the molten metal is solidified, an outer contour unit configured from a plurality of outer contour defining members for defining the outer contour of the casting and an inner contour unit configured from a plurality of inner contour defining members for defining the inner contour of the casting set at the inner side of the outer contour unit, and moving, at the time of drawing out the molten metal which has been drawn out from the bath surface through a region determined by the outer contour unit and the inner contour unit, at least one of the plurality of outer contour defining members and/or at least one of the plurality of inner contour defining members coincident with the drawing out of the molten metal. Accordingly, the form of the molten metal in a soft state can be desirably changed while drawing out the molten metal from the bath surface of the molten metal bath, and thus, the degree of freedom of form of a casting to be manufactured can be drastically increased.

Furthermore, according to the manufacturing method described above, adjacent outer contour defining members, of the plurality of outer contour defining members, may be arranged being separated from each other, or adjacent inner contour defining members, of the plurality of inner contour defining members, may be arranged being separated from each other.

According to the manufacturing method described above, movable space can be prepared for the plurality of outer contour defining members constituting the outer contour unit and the plurality of inner contour defining members constituting the inner contour unit, therefore the plurality of outer contour defining members and the plurality of inner contour defining members can be freely moved according to the drawing out of molten metal, and the degree of freedom of form of a casting to be manufactured can be even more increased. Additionally, when adjacent outer contour defining members or adjacent inner contour defining members are arranged being separated from each other, the form of molten metal between the members is temporarily retained by an oxide film formed on the surface or surface tension.

Also, a manufacturing device of a casting of the present invention includes a molten metal bath for storing molten metal, cooling means for solidifying the molten metal drawn out from a bath surface of the molten metal bath, an outer contour unit that is configured from a plurality of outer contour defining members for defining an outer contour of a casting, the outer contour unit being arranged in a region between the bath surface of the molten metal bath and a solid region where the molten metal is solidified by the cooling means, and moving means for moving at least one of the plurality of outer contour defining members according to the drawing out of the molten metal.

Here, examples of the cooling means adopted by the manufacturing device described above include means for directly cooling the molten metal drawn out from the bath surface using a coolant or the like, means for indirect cooling via metallic starting device, made of metal, used for drawing out molten metal or an already solidified portion of the molten metal, and a plurality of cooling means may be used in combination. Additionally, examples of coolant used by the cooling means described above include a gas such as air or inert gas, and a liquid such as water.

According to the manufacturing device described above, an outer contour unit configured from a plurality of outer contour defining members for defining the outer contour of a casting is arranged in a region between the bath surface of a molten metal bath and a solid region where the molten metal is solidified by the cooling means, and at least one of the plurality of outer contour defining members can be moved using moving means, and since the outer contour of molten metal in a soft state can be desirably changed by moving at least one of the plurality of outer contour defining members while drawing out the molten metal from the bath surface of the molten metal bath, a casting having a complex form can be easily manufactured, and the degree of freedom of form of a casting to be manufactured can be increased.

Further preferably included are an inner contour unit that is configured from a plurality of inner contour defining members for defining an inner contour of the casting, the inner contour unit being arranged at an inner side of the outer contour unit and in a region between the bath surface of the molten metal bath and the solid region where the molten metal is solidified by the cooling means, and moving means for moving at least one of the plurality of inner contour defining members according to the drawing out of the molten metal.

According to the manufacturing device described above, an outer contour unit configured from a plurality of outer contour defining members for defining the outer contour of a casting and an inner contour unit configured from a plurality of inner contour defining members for defining the inner contour of the casting are arranged at the inner side of the outer contour unit and in the region between the bath surface of a molten metal bath and a solid region where the molten metal is solidified by the cooling means, and at least one of the plurality of outer contour defining members and the plurality of inner contour defining members can be moved using moving means, and since the form of molten metal in a soft state can be desirably changed by moving at least one of the plurality of outer contour defining members and the plurality of inner contour defining members while drawing out the molten metal from the bath surface of the molten metal bath, the degree of freedom of form of a casting to be manufactured can be drastically increased.

Furthermore, according to the manufacturing device described above, adjacent outer contour defining members, of the plurality of outer contour defining members, may be arranged being separated from each other, or adjacent inner contour defining members, of the plurality of inner contour defining members, may be arranged being separated from each other.

Still further, according to the manufacturing device described above, at least the plurality of outer contour defining members or the plurality of inner contour defining members may be in line contact with the molten metal that is drawn out through a region determined by the outer contour unit and the inner contour unit, or at least the plurality of outer contour defining members or the plurality of inner contour defining members may be in surface contact with the molten metal that is drawn out through a region determined by the outer contour unit and the inner contour unit.

In the case at least the plurality of outer contour defining members or the plurality of inner contour defining members are in line contact with the molten metal that is drawn out through a region determined by the outer contour unit and the inner contour unit, the outer contour defining members and the inner contour defining members constituting the outer contour unit and the inner contour unit can be miniaturized, and the frame of the whole manufacturing device can be miniaturized by reducing the driving torque of the moving means or the like, for example. Also, in the case at least the plurality of outer contour defining members or the plurality of inner contour defining members are in surface contact with the molten metal that is drawn out through a region determined by the outer contour unit and the inner contour unit, the molten metal that is drawn out through the region determined by the outer contour unit and the inner contour unit can be supported by a larger area, and the accuracy of form of a casting to be manufactured can be even more increased.

Also, a casting of the present invention is a casting solidified after forming molten metal drawn out from a molten metal surface of a molten metal bath, where an outer contour unit configured from a plurality of outer contour defining members for defining an outer contour of the casting is arranged in a region between the bath surface of the molten metal bath and a solid region where the molten metal is solidified, and where the casting is formed by the outer contour being changed by at least one of the plurality of outer contour defining members being moved according to the drawing out of the molten metal at a time of the molten metal drawn out from the bath surface through a region determined by the outer contour unit.

According to the casting described above, although the outer contour of molten metal is changed depending on the drawing out of the molten metal, it is possible to make the solidification structure directional by the continuous solidification of the molten metal drawn out from the bath surface of the molten metal bath, and the quality can be effectively improved in spite of the complex form.

Furthermore, according to the casting described above, an inner contour unit configured from a plurality of inner contour defining members for defining an inner contour of the casting set at an inner side of the outer contour unit is preferably arranged in the region between the bath surface of the molten metal bath and the solid region where the molten metal is solidified, and the casting is preferably formed by the inner contour being changed by at least one of the plurality of inner contour defining members being moved depending on the drawing out of the molten metal coincident with the molten metal drawn out from the bath surface being drawn out through a region determined by the outer contour unit and the inner contour unit.

According to the casting described above, the outer contour and the inner contour of the molten metal are changed depending on the drawing out of the molten metal, resulting in a casting having an even more complex form.

As can be understood from the Description above, according to the manufacturing method of a casting and a manufacturing device thereof of the present invention, the degree of freedom of design of a casting can be effectively increased by a simple method, and productivity can be increased with respect to castings having complex forms.

BRIEF DESCRIPTION OF THE DRAWINGS

FIG. 1 is a vertical cross-sectional view describing a manufacturing method of a casting of the present invention, and (a) is a view describing a state immediately after drawing out of molten metal from a molten metal bath and (b) is a view describing a state where a part of the molten metal drawn out from the molten metal bath is solidified.

FIG. 5 is a view describing a state immediately after drawing out of molten metal from a molten metal bath using the manufacturing device shown in FIG. 4, and (a) is a vertical cross-sectional view thereof and (b) is an arrow view along line A1-A1 in FIG. 5(*a*).

FIG. 6 is a view describing a state where a part of molten metal drawn out from a molten metal bath using the manufacturing device shown in FIG. 4 is solidified, and (a) is a vertical cross-sectional view thereof and (b) is an arrow view along line B1-B1 in FIG. 6(*a*).

FIG. 7 is a perspective view showing an embodiment 1 of a casting manufactured by the manufacturing device shown in FIG. 4.

FIG. 8 is a perspective view showing an embodiment 2 of the manufacturing device of a casting of the present invention.

FIG. 9 is a view describing a state immediately after drawing out of molten metal from a molten metal bath using the manufacturing device shown in FIG. 8, and (a) is a vertical cross-sectional view thereof and (b) is an arrow view along line A2-A2 in FIG. 9(*a*).

DETAILED DESCRIPTION OF THE PREFERRED EMBODIMENTS

Figure 2:
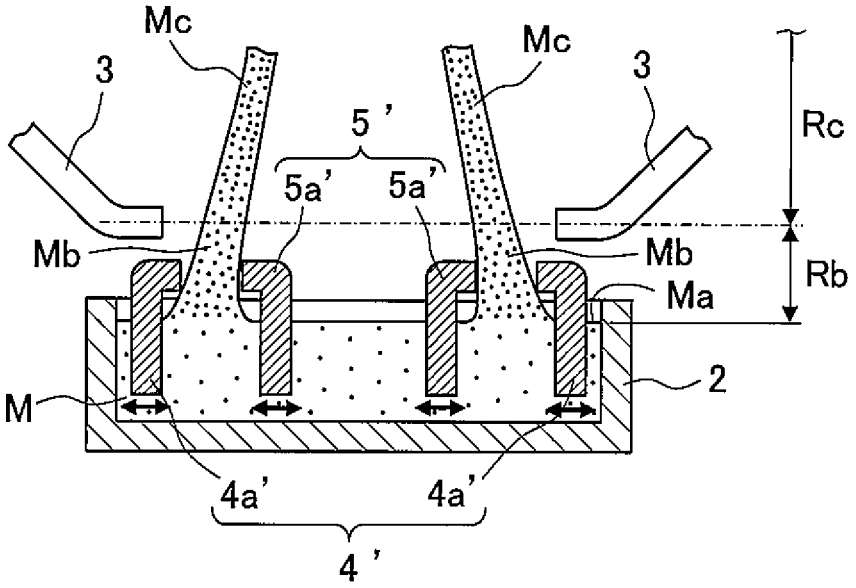
FIG. 2 is a vertical cross-sectional view describing another embodiment of the manufacturing method of a casting shown in FIG. 1.

Hereinafter, embodiments of a manufacturing method of a casting of the present invention, a manufacturing device thereof, and a casting that is manufactured using the manufacturing device will be described with reference to the drawings.

Embodiment of Manufacturing Method of Casting

FIG. 1 is a vertical cross-sectional view describing a manufacturing method of a casting of the present invention, and FIG. 1(*a*) is a view describing a state immediately after drawing out of molten metal from a molten metal bath and FIG. 1(*b*) is a view describing a state where a part of the molten metal drawn out from the molten metal bath is solidified.

The manufacturing method of a casting of the present embodiment mainly includes a drawing process of drawing out molten metal from a molten metal bath, and a forming process of forming and solidifying the molten metal drawn out from the molten metal bath, and the drawing process and the forming process are performed as one process in the case casting is to be continuously performed.

First, as shown in FIG. 1(*a*), metallic starting device 1 having a basic form (for example, a tubular form having a circular cross section, a polygonal cross section or the like) according to the form of a casting is brought into contact with molten metal M stored in a molten metal bath 2 and the metallic starting device 1 is separated from a bath surface Ma of the molten metal M in the molten metal bath 2, to thereby draw out the molten metal M from the bath surface Ma of the molten metal bath 2.

Here, in the case the ambient atmosphere of the molten metal M drawn out from the bath surface Ma of the molten metal bath 2 is air atmosphere or oxidizing atmosphere, an oxide film forms on the surface of the drawn molten metal M, and in the case the nitrogen atmosphere, a nitride film forms on the surface of the drawn molten metal M. Furthermore, even if the atmosphere is other than the air atmosphere, the oxidizing atmosphere or the nitrogen atmosphere where no surface film is formed, surface tension acts on the surface of the drawn molten metal M. In this manner, the form of the surface of the molten metal M drawn out from the bath surface Ma of the molten metal bath 2 is temporarily retained by the oxide film, a nitride film, surface tension or the like, and molten metal Mb in a soft state (a semi-solid state) whose form is retained (hereinafter, referred to as "retained molten metal") is formed between the bath surface Ma of the molten metal bath 2 and the metallic starting device 1. The molten metal M is continuously drawn out from the bath surface Ma of the molten metal bath 2 by the retained molten metal Mb gradually separating from the bath surface Ma of the molten metal bath 2 following the movement of the metallic starting device 1 and the molten metal M being drawn out from the bath surface Ma of the molten metal bath 2 following the retained molten metal Mb in a semi-solid state.

Next, as shown in FIG. 1(*b*), the retained molten metal Mb which has been drawn out from the molten metal bath 2 and which is in a semi-solid state is solidified using a fluid nozzle 3 ejecting a cooling fluid onto the molten metal as a cooling means, and molten metal Mc in a solid state is formed.

Here, an outer contour unit 4 configured from a plurality of outer contour defining members 4*a* for defining the outer contour of a casting to be manufactured and an inner contour unit 5 configured from a plurality of inner contour defining members 5*a* for defining the inner contour of the casting are arranged at the inner side of the outer contour unit 4 and in a region Rb (for example, a region of about several tens of millimeters) between the bath surface Ma of the molten metal M in the molten metal bath 2 and a solid region Rc where the molten metal is solidified and the molten metal Mc in a solid state is formed, and the outer contour defining members 4*a* constituting the outer contour unit 4 and the inner contour defining members 5*a* constituting the inner contour unit 5 are capable of freely moving in any direction according to the drawing out of the molten metal M.

Accordingly, the molten metal M drawn out from the bath surface Ma of the molten metal M in the molten metal bath 2 is drawn out through a region determined by the outer contour unit 4 and the inner contour unit 5, and also, the thickness and the shapes of the outer contour and the inner contour of the casting to be manufactured are arbitrarily changed by the outer contour defining members 4*a* and the inner contour defining members 5*a* being moved in an arbitrary direction according to the drawing out of the molten metal M and the inner contour and the outer contour of the retained molten metal Mb before cooling being changed.

Additionally, in the illustrated example, most parts of the outer contour defining members 4*a* constituting the outer contour unit 4 and the inner contour defining members 5*a* constituting the inner contour unit 5 are immersed in the molten metal M and only some parts thereof are protruded from the bath surface Ma of the molten metal M, and the outer contour and the inner contour of the retained molten metal Mb are defined at positions near the bath surface Ma of the molten metal M. The molten metal M can therefore be formed at a position that is most softened of the molten metal M drawn out from the bath surface Ma of the molten metal Min the molten metal bath 2.

On the other hand, as shown in FIG. 2, of outer contour defining members 4*a*' constituting an outer contour unit 4' and inner contour defining members 5*a*' constituting an inner contour unit 5', parts that are in contact with the retained molten metal Mb may be arranged being separated from the bath surface Ma of the molten metal M by a predetermined distance. The molten metal M can therefore be formed at a position near the solid region Rc where the molten metal M is solidified, and the accuracy of form of the casting to be manufactured can be further increased.

Figure 3:
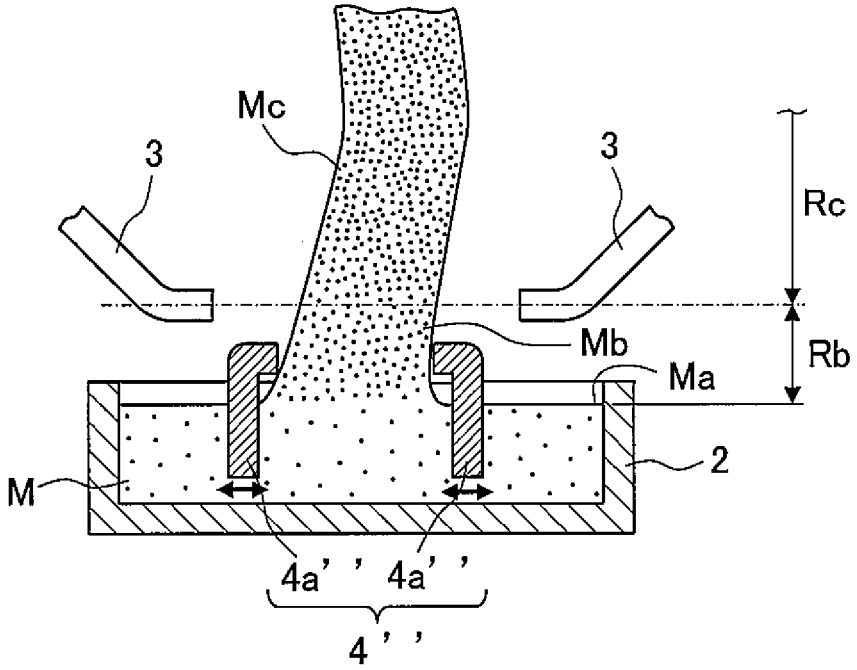
FIG. 3 is a vertical cross-sectional view describing still another embodiment of the manufacturing method of a casting shown in FIG. 1.

Furthermore, as shown in FIG. 3, it is possible to omit the inner contour unit 5 shown in FIG. 1 configured from a plurality of inner contour defining members 5*a* for defining the inner contour of a casting, and to arrange only an outer contour unit 4" configured from a plurality of outer contour defining members 4*a*" for defining the outer contour of a casting to be manufactured in the region Rb between the bath surface Ma of the molten metal M in the molten metal bath 2 and the solid region Rc where the molten metal is solidified and molten metal Mc in a solid state is formed. The molten metal M drawn out from the bath surface Ma of the molten metal M in the molten metal bath 2 is thereby drawn out through a region determined only by the outer contour unit 4", and the outer contour or thickness of a solid casting is arbitrarily changed by the outer contour defining members 4*a*" being moved in an arbitrary direction according to the drawing out of the molten metal M and the outer contour of the retained molten metal Mb before cooling being changed. Also, as shown in the drawing, by moving the outer contour defining members 4*a*" according to the drawing out of the molten metal Min an arbitrary direction, a cross-sectional center position of the solid casting in the horizontal cross section can be arbitrarily changed.

Furthermore, in the embodiment shown in FIG. 1, a mode has been described of adopting a jig such as a spatula, a guide, a roller or the like as the outer contour defining member 4*a* constituting the outer contour unit 4 or the inner contour defining member 5*a* constituting the inner contour unit 5, but the outer contour or the inner contour of the casting may be defined by spraying fluid whose amount or pressure is controlled.

Furthermore, the metallic starting device 1 that is used to draw out the molten metal M may be formed of the same metal as the molten metal, and be made a part of the casting that is manufactured. On the other hand, it may be formed of a metal of a different kind than the molten metal, such as iron, and may be used again as the metallic starting device by being cut off from a casting after it has been manufactured.

Embodiment 1 of Casting and Manufacturing Device Thereof

Figure 4:
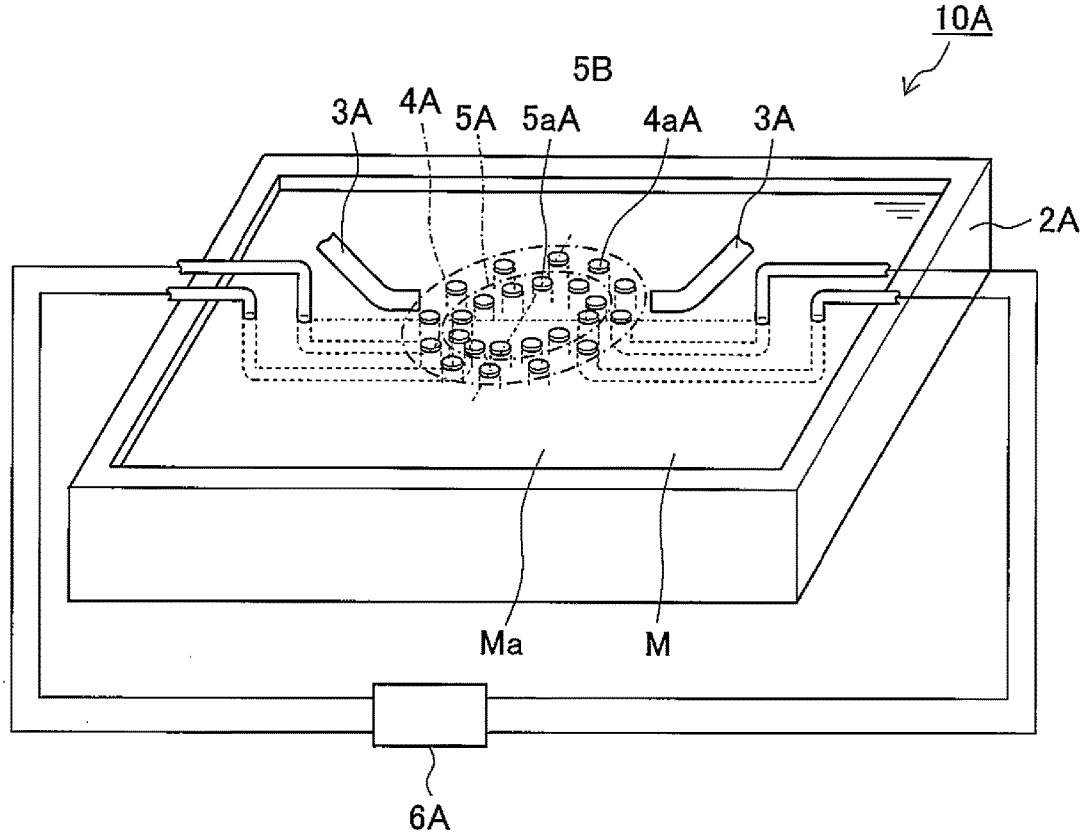
FIG. 4 is a perspective view showing an embodiment 1 of a manufacturing device of a casting of the present invention.

FIG. 4 is a perspective view showing an embodiment 1 of a manufacturing device of a casting of the present invention. Also, FIG. 5 is a view describing a state immediately after drawing out of molten metal from a molten metal bath using the manufacturing device shown in FIG. 4, and FIG. 5(*a*) is a vertical cross-sectional view thereof and FIG. 5(*b*) is an arrow view along line A1-A1 in FIG. 5(*a*). Also, FIG. 6 is a view describing a state where a part of molten metal drawn out from a molten metal bath using the manufacturing device shown in FIG. 4 is solidified, and FIG. 6(*a*) is a vertical cross-sectional view thereof and FIG. 6(*b*) is an arrow view along line B1-B1 in FIG. 6(*a*). Furthermore, FIG. 7 is a perspective view showing an embodiment 1 of a casting manufactured by the manufacturing device shown in FIG. 4.

A manufacturing device 10A shown in FIG. 4 includes a molten metal bath 2A for storing molten metal M, cooling means 3A for solidifying molten metal drawn out from a bath surface Ma of the molten metal M in the molten metal bath 2A, an outer contour unit 4A configured from a plurality of outer contour defining members 4*a*A for defining the outer contour of a casting, the outer contour unit 4A being arranged in a region between the bath surface Ma of the molten metal bath 2A and a solid region where the molten metal M is solidified by the cooling means 3A, an inner contour unit 5A configured from a plurality of inner contour defining members 5*a*A for defining the inner contour of the casting, the inner contour unit 5A being arranged at the inner side than the outer contour unit 4A, and moving means 6A for individually moving the plurality of outer contour defining members 4*a*A and the plurality of inner contour defining members 5*a*A according to the drawing out of the molten metal. Additionally, in the illustrated example, the connected state with the moving means 6A is omitted with respect to some of the plurality of the outer contour defining members 4*a*A and the plurality of the inner contour defining members 5*a*A.

In the manufacturing device 10A of the embodiment 1, the plurality of outer contour defining members 4*a*A constituting the outer contour unit 4A and the plurality of inner contour defining members 5*a*A constituting the inner contour unit 5A are concentrically arranged, adjacent members of the plurality of outer contour defining members 4*a*A and the plurality of inner contour defining members 5*a*A are distributed at regular intervals in the circumferential direction, and the plurality of outer contour defining members 4*a*A and the plurality of inner contour defining members 5*a*A are moved in synchronization according to the drawing out of the molten metal M. Furthermore, the plurality of outer contour defining members 4*a*A and the plurality of inner contour defining members 5*a*A have parts of their tips arranged in such a manner as to protrude from the bath surface Ma of the molten metal M in the molten metal bath 2A.

A method of manufacturing a casting using the manufacturing device 10A shown in FIG. 4 will be briefly described. First, as shown in FIG. 5(*a*), a metallic starting device 1A having a substantially cylindrical form is brought into contact with the molten metal M stored in the molten metal bath 2A and the metallic starting device 1A is separated from the bath surface Ma of the molten metal M in the molten metal bath 2A, to thereby draw out the molten metal M from the bath surface Ma of the molten metal bath 2A. At this time, as shown in FIG. 5(*b*), the plurality of outer contour defining members 4*a*A and the plurality of inner contour defining members 5*a*A are arranged concentrically, and the plurality of outer contour defining members 4*a*A and the plurality of inner contour defining members 5*a*A are arranged at regular intervals along their respective circumferences. The molten metal M drawn out from the bath surface Ma of the molten metal M in the molten metal bath 2A is drawn out through a region determined by the plurality of outer contour defining members 4*a*A and the plurality of inner contour defining members 5*a*A, and therefore, a retained molten metal Mb having a substantially circular cross section is formed between the metallic starting device 1A having a substantially cylindrical form and the bath surface Ma of the molten metal M in the molten metal bath 2A.

Next, as shown in FIG. 6(*a*), the metallic starting device 1A is moved so as to be separated from the bath surface Ma of the molten metal bath 2A, and the retained molten metal Mb in a semi-solid state that is formed between the metallic starting device 1A and the bath surface Ma of the molten metal bath 2A is solidified using the cooling means 3A to form molten metal Mc in a solid state. At this time, the plurality of outer contour defining members 4*a*A and the plurality of inner contour defining members 5*a*A are each moved by the moving means 6A (see FIG. 4) in synchronization with the drawing out of the molten metal M from the bath surface Ma.

As shown in FIG. 6(*b*), in the manufacturing device 10A of the embodiment 1, the plurality of outer contour defining members 4*a*A and the plurality of inner contour defining members 5*a*A are moved in the direction of expansion in the radial direction, resulting in a substantially oval cross-sectional shape. Also, the amount of movement of some of the outer contour defining members 4*a*A is greater than the amount of movement of the corresponding inner contour defining members 5*a*A, and thus, a formed body having a variable thickness in the circumferential direction is formed.

Accordingly, as shown in FIG. 7, according to the manufacturing device 10A of the embodiment 1, a casting Md of the embodiment 1 whose upper end portion has a substantially circular cross section and whose lower end portion has a substantially oval cross section and is different in its thickness in the circumferential direction is formed.

Embodiment 2 of Casting and Manufacturing Device Thereof

Figure 10:
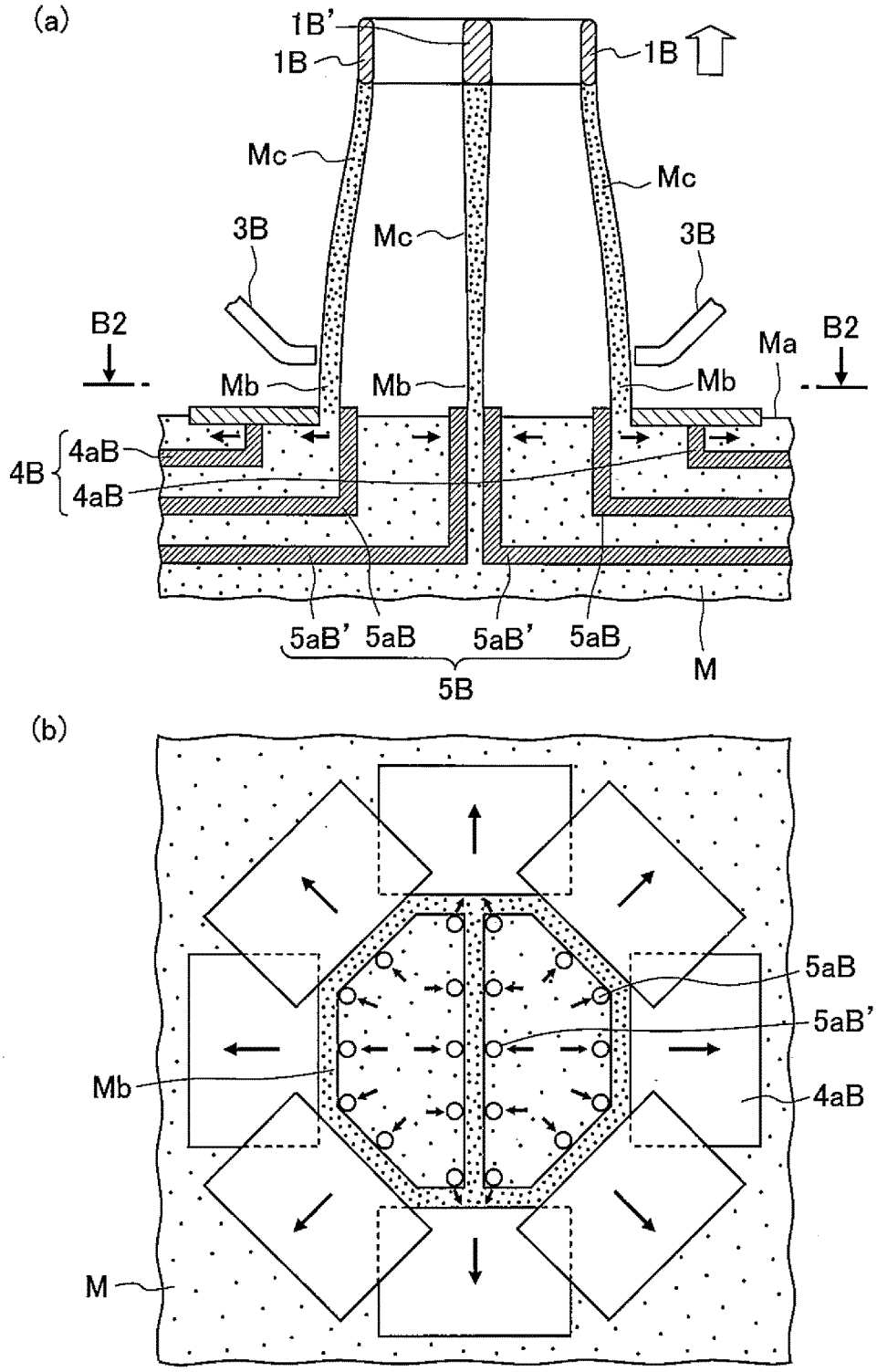
FIG. 10 is a view describing a state where a part of molten metal drawn out from a molten metal bath using the manufacturing device shown in FIG. 8 is solidified, and (a) is a vertical cross-sectional view thereof and (b) is an arrow view along line B2-B2 in FIG. 10(*a*).
Figure 11:
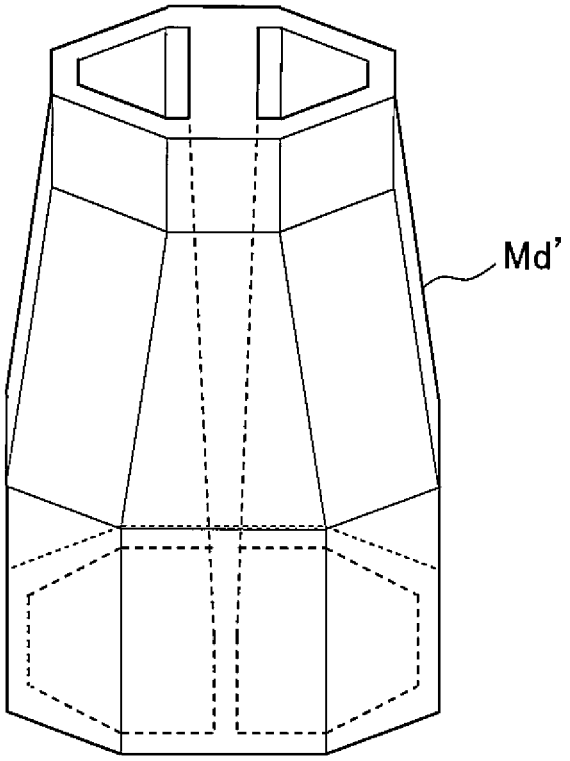
FIG. 11 is a perspective view showing an embodiment 2 of a casting manufactured by the manufacturing device shown in FIG. 8.

FIG. 8 is a perspective view showing an embodiment 2 of the manufacturing device of a casting of the present invention. Also, FIG. 9 is a view describing a state immediately after drawing out of molten metal from a molten metal bath using the manufacturing device shown in FIG. 8, and FIG. 9(*a*) is a vertical cross-sectional view thereof and FIG. 9(*b*) is an arrow view along line A2-A2 in FIG. 9(*a*). Also, FIG. 10 is a view describing a state where a part of molten metal drawn out from a molten metal bath using the manufacturing device shown in FIG. 8 is solidified, and FIG. 10(*a*) is a vertical cross-sectional view thereof and FIG. 10(*b*) is an arrow view along line B2-B2 in FIG. 10(*a*). Furthermore, FIG. 11 is a perspective view showing an embodiment 2 of a casting manufactured by the manufacturing device shown in FIG. 8.

A manufacturing device 10B of the embodiment 2 shown in FIG. 8 is different from the manufacturing device 10A of the embodiment 1 shown in FIG. 4 in the mode of outer contour defining members 4*a*B for defining the outer contour of a casting, and other elements are substantially the same. Specifically, the outer contour defining members 4*a*B are each made of a rectangular plate, and the whole outer periphery of a formed body can be defined by the outer contour defining members 4*a*B by parts of adjacent outer contour defining members 4*a*B overlapping each other.

The manufacturing device 10B shown in FIG. 8 includes a molten metal bath 2B for storing molten metal M, cooling means 3B for solidifying molten metal drawn out from a bath surface Ma of the molten metal M in the molten metal bath 2B, an outer contour unit 4B configured from a plurality of outer contour defining members 4*a*B for defining the outer contour of a casting, the outer contour unit 4B being arranged in a region between the bath surface Ma of the molten metal bath 2B and a solid region where the molten metal M is solidified by the cooling means 3B, an inner contour unit 5B configured from a plurality of inner contour defining members 5*a*B for defining the inner contour of the casting, the inner contour unit 5B being arranged on the inner side than the outer contour unit 4B, and moving means 6B for individually moving the plurality of outer contour defining members 4*a*B and the plurality of inner contour defining members 5*a*B according to drawing out of the molten metal. Additionally, also in the embodiment 2, as in the embodiment 1, the connected state with the moving means 6B is omitted with respect to some of the plurality of the outer contour defining members 4*a*B and the plurality of the inner contour defining members 5*a*B.

Here, as described above, in the manufacturing device 10B of the embodiment 2, the outer contour defining members 4*a*B constituting the outer contour unit 4B are formed of substantially rectangular plates, and are made to contact molten metal M drawn out from the bath surface Ma in a planar fashion. Also, inner contour defining members 5*a*B' for forming a rib are provided at a center portion of the inner contour defining members 5*a*B constituting the inner contour unit 5B. As with the manufacturing device 10A of the embodiment 1, the plurality of outer contour defining members 4*a*B constituting the outer contour unit 4B and the plurality of inner contour defining members 5*a*B constituting the inner contour unit 5B are arranged concentrically, and the plurality of outer contour defining members 4*a*B and the plurality of inner contour defining members 5*a*B are moved in synchronization according to the drawing out of the molten metal M. Additionally, parts of adjacent outer contour defining members 4*a*B are arranged overlapping each other, and thus, the whole outer periphery of a formed body can be defined by the outer contour defining members 4*a*B even when the outer contour defining members 4*a*B are moved.

A method of manufacturing a casting using the manufacturing device 10B shown in FIG. 8 will be briefly described. First, as shown in FIG. 9(*a*), a metallic starting device 1B having a joint portion 1B' for forming a rib provided on a substantially hexagonal tube is brought into contact with the molten metal M stored in the molten metal bath 2B and the metallic starting device 1B is separated from the bath surface Ma of the molten metal M in the molten metal bath 2B, to thereby draw out the molten metal M from the bath surface Ma of the molten metal bath 2B. At this time, as shown in FIG. 9(*b*), the plurality of outer contour defining members 4*a*B and the plurality of inner contour defining members 5*a*B and 5*a*B' are arranged, and the molten metal M drawn out from the bath surface Ma of the molten metal M in the molten metal bath 2B is drawn out through a region determined by the plurality of outer contour defining members 4*a*B and the plurality of inner contour defining members 5*a*B and a region determined by the plurality of inner contour defining member 5*a*B', and therefore, a retained molten metal Mb having a substantially hexagonal cross section and a rib portion is formed between the metallic starting device 1B and the bath surface Ma of the molten metal M in the molten metal bath 2B.

Next, as shown in FIG. 10(*a*), the metallic starting device 1B is moved so as to be separated from the bath surface Ma of the molten metal bath 2B, and the retained molten metal Mb in a semi-solid state that is formed between the metallic starting device 1B and the bath surface Ma of the molten metal bath 2B is solidified using the cooling means 3B to form molten metal Mc in a solid state. At this time, the plurality of outer contour defining members 4*a*B and the plurality of inner contour defining members 5*a*B and 5*a*B' are each moved by the moving means 6B (see FIG. 8) in synchronization with the drawing out of the molten metal M from the bath surface Ma.

As shown in FIG. 10(*b*), in the manufacturing device 10B of the embodiment 2, the plurality of outer contour defining members 4*a*B and the plurality of inner contour defining members 5*a*B are moved in the direction of expansion in the radial direction, causing the outer periphery to be gradually larger. Also, the plurality of outer contour defining members 4*a*B move greater than the plurality of inner contour defining members 5*a*B, and the thickness is made to gradually increase. Furthermore, the plurality of inner contour defining members 5*a*B' move inward to form the rib portion, and the thickness of the rib portion is gradually reduced.

Accordingly, as shown in FIG. 11, according to the manufacturing device 10B of the embodiment 2, a casting Md' of the embodiment 2 whose cross section is substantially hexagonal and whose thickness is greater as it gets nearer to the lower end portion, and within which a rib portion is formed, the thickness of the rib portion becoming less as it gets nearer to the lower end portion, is manufactured.

Heretofore, embodiments of the present invention have been described in detail with reference to the drawings, but the concrete configuration is not limited by these embodiments, and any changes in the design and the like within the spirit of the present invention are included in the present invention.

1 Metallic starting device
2 Molten metal bath
3 Cooling means
4 Outer contour unit
4*a* Outer contour defining member
5 Inner contour unit
5*a* Inner contour defining member
M Molten metal
Ma Bath surface
Mb Retained molten metal
Mc Molten metal in solid state
Md Casting

The invention claimed is:

1. A manufacturing method of a casting comprising:

drawing out molten metal upwardly from a bath surface of a molten metal bath to form a body of drawn molten metal and solidifying the drawn molten metal to provide a casting, arranging an outer contour unit configured from a plurality of outer contour defining members for defining an outer contour of the casting in a region between the bath surface of the molten metal bath and a solid region where the drawn molten metal is solidified, wherein in the step of drawing out the molten metal, the molten metal is drawn out from the bath surface through a region determined by the outer contour unit, and changing the outer contour of the casting by moving at least one of the plurality of outer contour defining members according to the drawing out of the molten metal.

2. The manufacturing method of a casting according to claim 1, wherein, of the plurality of outer contour defining members, adjacent outer contour defining members are arranged being separated from each other.

3. The manufacturing method of a casting according to claim 1, wherein the outer contour unit is arranged at a predetermined distance from the bath surface, which predetermined distance corresponds to where the molten metal drawn out from the bath surface is solidified.

4. A manufacturing method of a casting including drawing out molten metal from a bath surface of a molten metal bath and solidifying the drawn molten metal, the manufacturing method comprising:

arranging an outer contour unit configured from a plurality of outer contour defining members for defining an outer contour of the casting in a region between the bath surface of the molten metal bath and a solid region where the molten metal is solidified and drawing out the molten metal drawn out from the bath surface through a region determined by the outer contour unit, and changing the outer contour of the casting by moving at least one of the plurality of outer contour defining members according to the drawing out of the molten metal, wherein an inner contour unit configured from a plurality of inner contour defining members for defining an inner contour of the casting is arranged at an inner side of the outer contour unit and in the region between the bath surface of the molten metal bath and the solid region where the molten metal is solidified and the molten metal drawn out from the bath surface is drawn out through a region determined by the outer contour unit and the inner contour unit, and the inner contour of the casting is changed by moving at least one of the plurality of inner contour defining members according to the drawing out of the molten metal.

5. The manufacturing method of a casting according to claim 4, wherein, of the plurality of inner contour defining members, adjacent inner contour defining members are arranged being separated from each other.

6. The manufacturing method of a casting according to claim 4, wherein, of the plurality of outer contour defining members, adjacent outer contour defining members are arranged being separated from each other.

7. The manufacturing method of a casting according to claim 6, wherein, of the plurality of inner contour defining members, adjacent inner contour defining members are arranged being separated from each other.

8. A manufacturing device of a casting comprising:

a molten metal bath for storing molten metal;

cooling means for solidifying the molten metal drawn out upwardly from a bath surface of the molten metal bath;

an outer contour unit that is configured from a plurality of movably mounted outer contour defining members for defining an outer contour of a casting, and the outer contour unit being arranged at a predetermined distance from the bath surface and in a region between the bath surface of the molten metal bath and a solid region where the molten metal is solidified by the cooling means.

9. The manufacturing device of a casting according to claim 8, wherein, of the plurality of outer contour defining members, adjacent outer contour defining members are arranged being separated from each other.

10. The manufacturing device of a casting according to claim 8, wherein the predetermined distance corresponds to where the molten metal drawn out from the bath surface is solidified.

11. A manufacturing device of a casting comprising:

a molten metal bath for storing molten metal;

cooling means for solidifying the molten metal drawn out from a bath surface of the molten metal bath;

an outer contour unit that is configured from a plurality of outer contour defining members for defining an outer contour of a casting, and the outer contour unit being arranged in a region between the bath surface of the molten metal bath and a solid region where the molten metal is solidified by the cooling means, further comprising:

an inner contour unit that is configured from a plurality of inner contour defining members for defining an inner contour of the casting, the inner contour unit being arranged at an inner side of the outer contour unit and in the region between the bath surface of the molten metal bath and the solid region where the molten metal is solidified by the cooling means, wherein at least one of the plurality of outer contour defining members and plurality of inner contour defining members is movably mounted.

12. The manufacturing device of a casting according to claim 11, wherein, of the plurality of inner contour defining members, adjacent inner contour defining members are arranged being separated from each other.

13. The manufacturing device of a casting according to claim 11, wherein at least the plurality of outer contour defining members or the plurality of inner contour defining members are in line contact with the molten metal that is drawn out through a region determined by the outer contour unit and the inner contour unit.

14. The manufacturing device of a casting according to claim 11, wherein at least the plurality of outer contour defining members or the plurality of inner contour defining members are in surface contact with the molten metal that is drawn out through a region determined by the outer contour unit and the inner contour unit.

15. The manufacturing device of a casting according to claim 11, wherein, of the plurality of outer contour defining members, adjacent outer contour defining members are arranged being separated from each other.

16. The manufacturing device of a casting according to claim 15, wherein, of the plurality of inner contour defining members, adjacent inner contour defining members are arranged being separated from each other.

* * * * *